United States Patent [19]

Fridrich et al.

[11] 4,283,598

[45] Aug. 11, 1981

[54] LINE POST INSULATOR WITH SWINGING STIRRUP AND CLAMPING JAWS FOR OVERHEAD LINES OF MORE THAN 1000 VOLTS

[75] Inventors: János Fridrich, Budapest; Zoltan Hetesi, Hosszúhetény; Gusztáv Kisteleki, Pécs; László Misángyi, Pécs; Emil Szegletes, Pecs; József Szabó, Dunaujvaros, all of Hungary

[73] Assignee: Finomkeramiaipari Müvek, Budapest, Hungary

[21] Appl. No.: 68,902

[22] Filed: Aug. 23, 1979

[30] Foreign Application Priority Data

Sep. 12, 1978 [HU] Hungary ..... FI-682

[51] Int. Cl.[3] ..... H01B 7/16

[52] U.S. Cl. ..... 174/169; 24/136 R

[58] Field of Search ..... 174/154, 155, 156, 168, 174/169, 172, 173, 176, 186, 188; 24/81 KK, 115 M, 136 R; 248/74 R

[56] References Cited

U.S. PATENT DOCUMENTS

| | | | |
|---|---|---|---|
| 359,812 | 3/1887 | Pennie | 174/156 |
| 466,726 | 1/1892 | Norgrave | 174/155 |
| 522,175 | 6/1894 | Andersen | 174/169 |
| 728,442 | 5/1903 | Burke | 174/156 X |
| 887,107 | 5/1906 | Locke | 174/168 X |
| 1,022,026 | 4/1912 | Guthrie | 174/155 |
| 2,224,960 | 12/1940 | Haour | 174/169 |

FOREIGN PATENT DOCUMENTS

| | | | |
|---|---|---|---|
| 1035722 | 8/1958 | Fed. Rep. of Germany | 174/169 |

*Primary Examiner*—Laramie E. Askin

[57] ABSTRACT

The invention is related to a line post insulator suitable for overhead lines of a higher voltage value than 1000 V. One of the practical examples of the line post insulator is equipped with a swinging stirrup placed in the insulator cap. In the swinging stirrup there is a tapered hole narrowing downwardly and holding clamping jaws. The clamping jaws are constructed so that they fit into the tapered hole. Another practical example of the line post insulator is suitable for fixing a conductor and/or a tie wire. In the insulator cap of this line post insulator a slot is formed narrowing in one axial direction of the conductor or the tie wire. In the narrowing slot above the conductor or the tie wire, a tapered clamping jaw is placed into the slot. In the slot there is a clamping jaw with parallel side edges placed under the conductor or the tie wire.

10 Claims, 4 Drawing Figures

LINE POST INSULATOR WITH SWINGING STIRRUP AND CLAMPING JAWS FOR OVERHEAD LINES OF MORE THAN 1000 VOLTS

The invention relates to a line post insulator suitable for overhead lines of a higher voltage value than 1000 V.

It is known that in the case of overhead lines with a voltage higher than 1000 V, the conductor is fixed to the support by inserting an insulator. The fixing of the conductor to the insulator is solved by different modes of mounting, e.g. it can be fixed to the insulator by a stirrup, a binding wire, a band or a clamping jaw with a screw, etc.

The conductor can be fastened to the insulator directly or into the head fitting located on the insulator. The fastening into the head fitting can be fixed or can swingfree by applying a swinging stirrup and screws.

In the case of applying a stirrup, the conductor is bound to the insulator head by means of a tie wire. The stirrup, however, is pressed to the insulator head and to the conductor. A disadvantage of said solution is that it requires much labor and the conductor must be protected against wear on the insulator to an increased degree.

A common diadvantage of the known solutions is that they are too complicated, require professional skill, and, furthermore, there is an increased possibility of faults. The mounting time takes 15 to 50 minutes for each insulator.

Our aim is to eliminate these disadvantages by means of the solution according to the invention, i.e. to provide line post insulators of a simpler construction and requiring less mounting time.

We have reached our aim by constructing a line post insulator for overhead lines of a higher voltage value than 1000 V, in which there is a tapered hole narrowing downwards and holding the clamping jaws in the swinging stirrup placed in the insulator cap. The clamping jaws are constructed so that they fit into the tapered hole. The clamping jaws are equipped with collars for hindering their displacement in the line direction; they are also equipped with a fastening plate that is movable into the tapered hole formed in the clamping jaws and in the swinging stirrup.

We have reached our aim also by constructing a line post insulator for overhead lines of a higher voltage value than 1000 V which is suitable for fixing the conductor and/or tie wire and which has a tapered hole in the insulator cap narrowing in one direction of the conductor or the tie wire. In said tapered hole a wedge-shaped or correspondingly tapered clamping jaw is placed above the conductor or tie wire. The clamping jaw is positioned in the slot. An outer collar slot suitable for holding the conductor or the tie wire is formed in the insulator cap. In the slot formed in the insulator cap under the conductor or the tie wire, there is a clamping jaw with parallel side edges.

The constructions of these self-closing line post insulators with wedged conductor fixing are simpler in comparison with former solutions and their mounting time takes 2 to 5 minutes in the case of each insulator.

Hereinafter we introduce the subject matter of the invention with a practical example on the basis of drawings.

In the case of the line post insulators according to the invention which are not used for working tension, the head fitting is fixed to the insulator head in the known way of sulfur joint fitting, cement mounting, etc.

Figure 1:
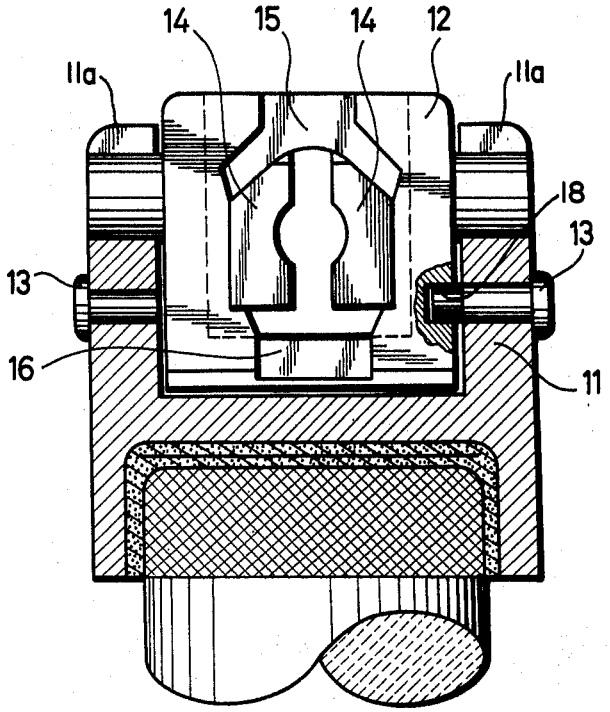
FIG. 1 shows one form of execution of the line post insulator according to the invention, frontwise and partly in cross-section.
Figure 2:
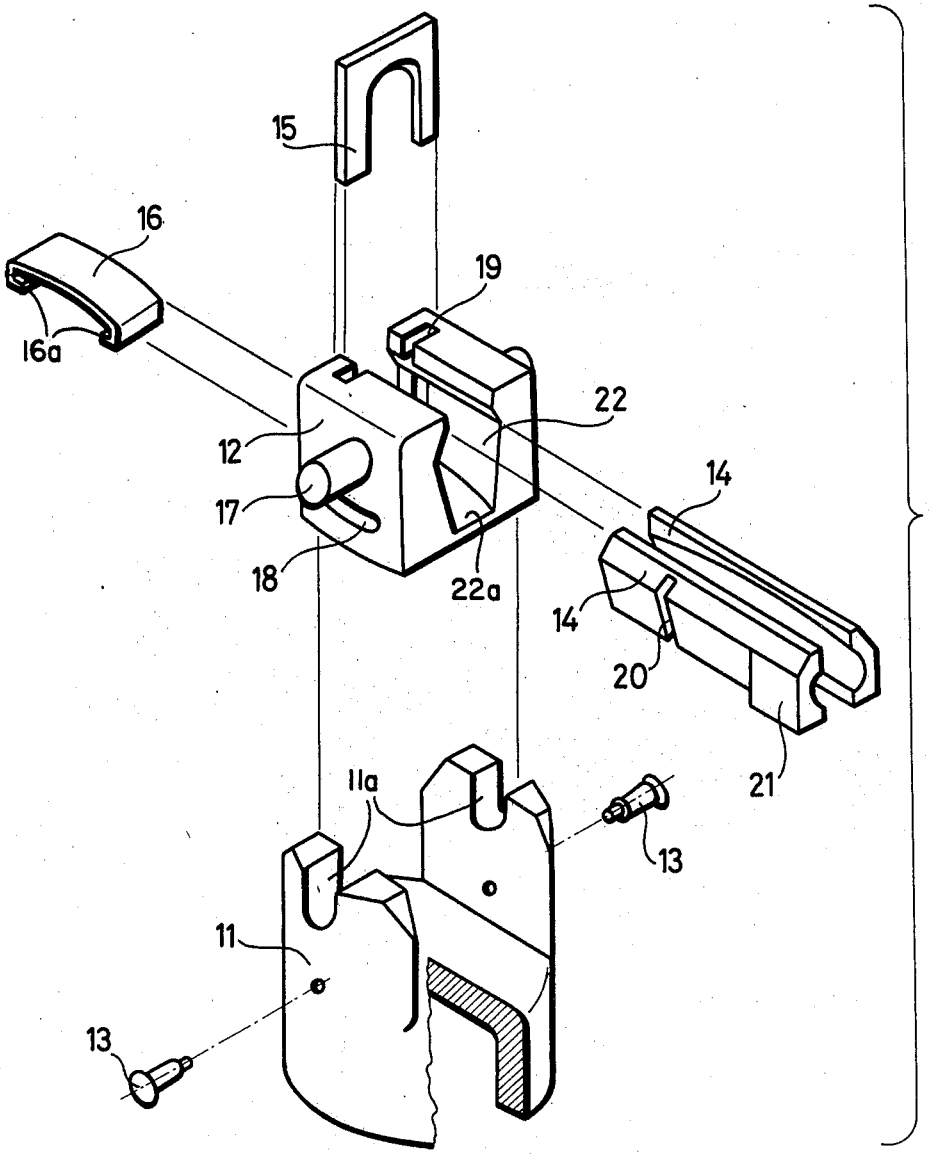
FIG. 2 shows an exploded view of the head fitting according to FIG. 1.

The line post insulator shown in FIGS. 1 and 2 is equipped with a swinging stirrup 12 placed in a forked insulator cap 11. The swinging stirrup 12 fits in the forked insulator cap 11 by means of a pair of laterally extending pins 17 formed on the surface of the swinging stirrup 12 and in engagement with recesses 11*a* formed on the insulator cap 11. The displacement of the swinging stirrup 12 in the vertical direction is hindered by pins 13 fitting in elongated slots or holes 18 formed in the swinging stirrup 12 and passing through the insulator cap 11. The fixing of the conductor is carried out by means of elongated clamping jaws 14. The clamping jaws 14 are placed in a downwardly narrowing or tapered hole 22 formed in the swinging stirrup 12; and the clamping jaws 14 are shaped so that they fit into the hole 22 which has a base wall 22*a* that is arcuate in the axial direction of the conductor. The clamping jaws 14 are equipped with collars 21 for hindering a displacement in the conductor's direction as well as with a fastening plate 15 movable into slots 19 and 20 formed in the swinging stirrup 12 and the clamping jaws 14, respectively.

The conductor is positioned between the clamping jaws 14 and the clamping jaws 14 are pressed against the conductor and moved into the tapered hole 22 of the swinging stirrup 12 until the collar 21 impacts against the swinging stirrup 12. The clamping jaws 14 are placed on the conductor before mounting so that the slots 20 on the clamping jaws 14 are in the same transverse plane as the slots 19 in the swinging stirrup 12 after having been pushed into the slot hole 22. Thereafter, the fastening plate 15 is moved into the now coplanar slots 19 and 20. In the course of network mounting a thin and easy wear, e.g. synthetic, C-shaped insert 16 having inwardly turned tabs 16*a* is placed at the bottom of the hole 22 in order to hinder the wear and tear of the conductor.

In an assembled state—due to the dead weight of the conductor—the clamping jaws 14 are seized in the hole 22 and thus the conductor is fixed automatically.

For different diameter conductors, arched slots of different radius are formed in the clamping jaws 14 to prevent the conductor from breaking.

These line pole insulators damp or absorb the vibrations of the conductor. The damping or absorption is ensured by the swinging stirrup 12 located in the head fitting.

Figure 3:
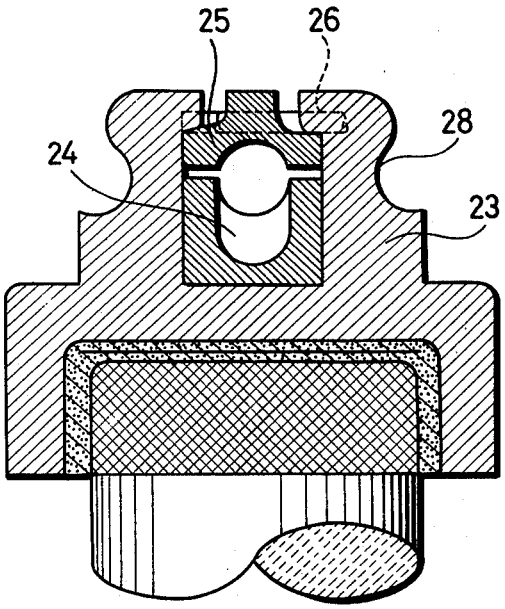
FIG. 3 shows another form of execution of the line post insulator according to the invention, frontwise and partly in cross-section.
Figure 4:
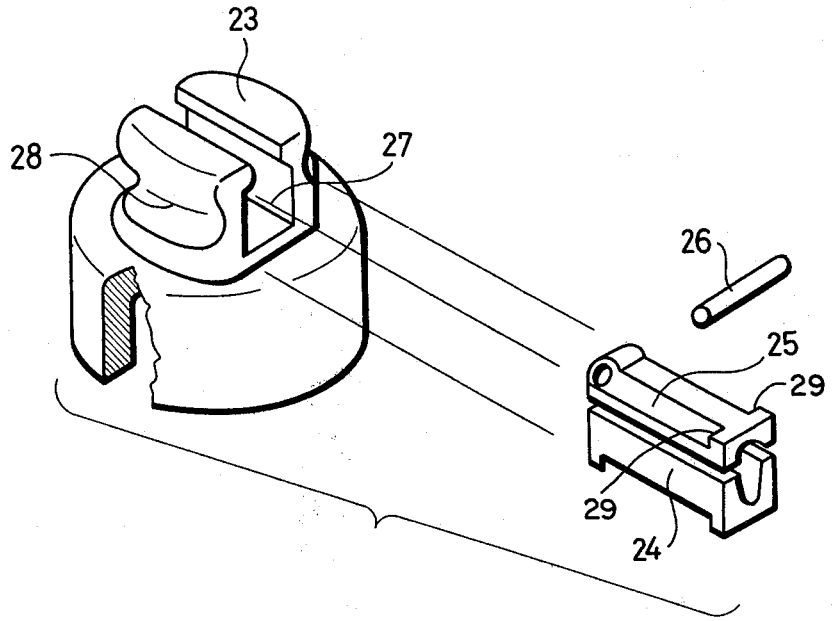
FIG. 4 shows an exploded view of the head fitting according to FIG. 3.

In the case of the practical example shown in FIGS. 3 and 4, a tapered slot 27 is formed in the insulator cap 23 which slot narrows in one direction of the conductor, or the tie wire. In the slot 27 elongated clamping jaws 24, 25 can be placed. The clamping jaw 25 placed above the conductor or the tie wire, is tapered according to the slot 27. The lower clamping jaw 24 serving to guide the conductor or the tie wire, has parallel side edges.

In the course of mounting, the conductor or the tie wire will be clamped by the clamping jaws 24, 25 and then pressed into the insulator cap 23. After mounting, the collars 29 at one end of the clamping jaw 25 and the fixing pin 26 in the hole formed in the opposite end of the clamping jaw 25 prevent the clamping jaw 25 from a longitudinal displacement in the slot 27.

When mounting with double suspension, the tie wire will be fixed between the clamping jaws 24, 25. In the case of mounting on an angle pole, the conductor is placed in the outer collar slot 28 of the insulator cap 23.

The line post insulators according to the invention can be applied e.g. in the following way.

In the case of single suspension, the practical example shown in FIG. 1 can be applied.

In the case of double suspension without a break of direction, the self-closing fixing (See FIG. 1) is applied to the insulator which is located in the path of the conductor. On the second insulator we apply for the tie wire a mode of fixing as shown in FIG. 3. In this case, the tie wire is fixed by the clamping jaws.

In the case of suspension on an angle pole, i.e. when the angle of break is bigger than 120° and one single insulator is sufficient for taking up the resultant forces, the line post insulator according to FIG. 3 is applied. The conductor will be placed in the collar slot 28 of the insulator cap 23 and fixed by means of a mounting-auxiliary-wire.

Should the angle of break be less than 120°—in case of an angle suspension—or should one single insulator be sufficient for taking up the resultant of the angle pull load, the mounting is carried out in accordance with FIG. 3 so that in case the insulator is located in the path of the conductor and functions permanently, the conductor will be fixed in the collar slot 28 of the insulator cap 23. If the insulator is not permanently under load, the tie wire will be fixed between the clamping jaws 24, 25.

In case of double suspension—if the angle of break is less than 120° or the resultant of the angle pull load is taken up by two insulators, the mounting will be carried out according to FIG. 3. In case of insulators which are permanently under load, the conductor will be fixed in the collar slot 28 of the insulator cap 23. However, in case of insulators not being permanently under load, the tie wire is fixed between the clamping jaws 24, 25 of the insulator cap 23.

The said two modes of execution complement each other in the course of mounting.

A further advantage of the solution according to the invention is that the conductor slots in the clamping jaws can be formed with radius dimensions according to need. This way, the changes in the conductor diameters can be followed and thus an adequate fixing of the conductor can always be constructed taking the very best solution into consideration on every given position.

What is claimed is:

1. A line post insulator for overhead lines designed for operating voltages higher than 1000 volts, said line post insulator comprising an insulator cap, a swinging stirrup located in said insulator cap, said swinging stirrup comprising a stirrup body portion and a pair of laterally extending pins integral therewith, said insulator cap including a central, longitudinal hole therethrough for receiving said stirrup body portion and a pair of transverse recesses for locating said laterally extending pins whereby said swinging stirrup is adapted to pivot about a transverse axis defined by the axes of said pins, said swinging stirrup including a longitudinal, central cavity therethrough defined by a pair of opposed, downwardly narrowing side walls, a bottom wall joining said downwardly narrowing side walls and a pair of opposed upwardly narrowing side walls, the upper end of said upwardly narrowing side walls defining a longitudinal, upper gap for the insertion of a line, and a pair of elongated clamping jaws extending longitudinally within said cavity for supporting opposite sides of an overhead line, said clamping jaws having side walls that conform to the shape of said downwardly narrowing side walls of said cavity, whereby an overhead line is can be clamped between said clamping jaws by the pressing force occurring between said jaws when said jaws are wedged in said cavity due to the weight of such line.

2. The line post insulator according to claim 1 further including limiting means for limiting the pivotal movement of said swinging stirrup.

3. The line post insulator according to claim 2 wherein said limiting means comprises at least one arcuate, elongated slot formed in said swinging stirrup and at least one hole formed in said insulator cap in alignment with said swinging stirrup slot, there being further included at least one pin positioned in said aligned slot and hole in said swinging stirrup and said insulator cap, respectively, whereby the ends of said slot in said swinging stirrup limit the pivotal movement of said swinging stirrup with repsect to said insulator cap.

4. The line post insulator according to claim 1 further including retaining means for preventing movement of said clamping jaws longitudinally.

5. The line post insulator according to claim 4 wherein said retaining means comprises first and second slot means formed in said clamping jaws and in said swinging stirrup, respectively, said first and said second slot means being aligned with each other in the same transverse plane when assembled, there being further included a U-shaped plate in engagement with said first and said second slot means to thereby prevent the movement of said clamping jaws longitudinally and relative to said swinging stirrup.

6. The line post insulator according to claim 1 further including stop means for determining the maximum insertion of said clamping jaws within said cavity.

7. The line post insulator according to claim 6 wherein said stop means comprises a shoulder formed on each of said clamping jaws, said shoulders being arranged to abut said swinging stirrup when said clamping jaws are within said cavity.

8. The line post insulator according to claim 1 further including an elongated wear retarding insert for an overhead line, said insert being positioned between said bottom wall in said cavity and the surfaces of said clamping jaws that are in opposition thereto.

9. The line post insulator according to claim 8 wherein said bottom wall is arcuate longitudinally and said insert conforms to the arcuate shape of said bottom wall.

10. The line post insulator according to claim 8 wherein said insert is C-shaped longitudinally and wherein the ends of said insert include inwardly directed tabs for gripping said swinging stirrup.

* * * * *